United States Patent [19]

Ono

[11] 4,052,848

[45] Oct. 11, 1977

[54] ANTI-AFTERBURN SYSTEM

[75] Inventor: Hiroaki Ono, Katsuragosho, Japan

[73] Assignee: Mitsubishi Jidosha Kogyo Kabushiki Kaisha, Tokyo, Japan

[21] Appl. No.: 602,263

[22] Filed: Aug. 6, 1975

[30] Foreign Application Priority Data

Feb. 27, 1975 Japan ..... 50-24572

[51] Int. Cl.[2] ..... F02B 75/10

[52] U.S. Cl. ..... 60/290

[58] Field of Search ..... 60/289, 290, 277; 123/117 A

[56] References Cited

U.S. PATENT DOCUMENTS

| | | | |
|---|---|---|---|
| 2,876,754 | 3/1959 | Obermaier | 123/117 A |
| 3,400,698 | 9/1968 | Kelly | 123/117 A |
| 3,805,522 | 4/1974 | Sheppard | 60/290 |
| 3,812,673 | 5/1974 | Muroki | 60/290 |
| 3,906,723 | 9/1975 | Matumoto | 60/290 |
| 3,919,843 | 11/1975 | Arnaud | 60/289 |
| 3,962,868 | 6/1976 | Matumoto | 60/290 |
| 3,978,834 | 9/1976 | Arnaud | 123/119 A |

*Primary Examiner*—Douglas Hart
*Attorney, Agent, or Firm*—Oldham & Oldham Co.

[57] ABSTRACT

An anti-afterburn system for an engine having an air pump, comprising a pressure differential responsive member defining two chambers, a control valve connected to said member, and at least one orifice provided in one of conduits connecting the chambers with an intake manifold of the engine to operate the control valve upon abrupt pressure variation in the intake manifold thereby preventing afterburn. The system further comprises a thermo valve means which is responsive to overheating of the engine or an exhaust system thereof and adapted to supply a pressure to one of the chambers to operate the control valve, thereby interrupting supply of the secondary air from the pump to prevent damages of a thermal reactor and generation of fire.

5 Claims, 5 Drawing Figures

ANTI-AFTERBURN SYSTEM

BACKGROUND OF INVENTION

This invention relates to an anti-afterburn system for an engine of a vehicle in which secondary air is supplied to an exhaust manifold of the engine for purifying exhaust gas.

In order to purify the exhaust gas, it has been known that secondary air is supplied to thermal reactors or catalytic convertors to reburn positively unburned gas to be discharged from the engine before it is discharged into the atmosphere. In this case, if the exhaust gas containing a large amount of unburned gas is discharged from the engine to the exhaust manifold, it reacts with the secondary air within the reactor or convertor, thereby causing an explosion or afterburn. When a throttle valve of a carburetor is opened or closed rapidly, richer air-fuel mixture is supplied to the engine and not burned completely in a combustion chamber thereof, so that said gas containing the unburned gas is discharged into said exhaust manifold to increase the generation of afterburn.

In conventional technics relating to anti-afterburn, there has been provided devices in which the supply of secondary air is terminated or fresh air is supplied to an intake manifold upon deceleration. However, in these devices, delay of operation thereof is occurred and due to this delay the afterburn is generated by the secondary air supplied before the deceleration.

Also, in an engine having a secondary air supply means, an exhaust gas purifying device provided in an exhaust system of the engine is heated by combustion heat of unburned gas contained in the exhaust gas. Particularly, in high loading running condition of the engine, said exhaust gas purifying device will be damaged by the heat and cause a fire.

SUMMARY OF INVENTION

An object of this invention is to provide an anti-afterburn system for an engine having an air pump, comprising a control valve for controlling secondary air supply from said pump to an exhaust system of the engine, a pressure differential responsive member dividing a housing into two chambers and being connected to said control valve, conduits connecting respectively said chambers with an intake manifold of the engine, a first orifice provided in one of said conduits so that said control valve is operated by abrupt variation of a pressure in said intake manifold to interrupt or reduce said secondary air supply, and a thermo valve means connected to said one conduit and adapted to supply a pressure at atmosphere or above the atmospheric pressure to one of said chambers connected to said one conduit when the thermo valve means is operated, thereby operating said control valve to interrupt said secondary air supply.

DESCRIPTION OF THE PREFERRED EMBODIMENTS

Figure 1:
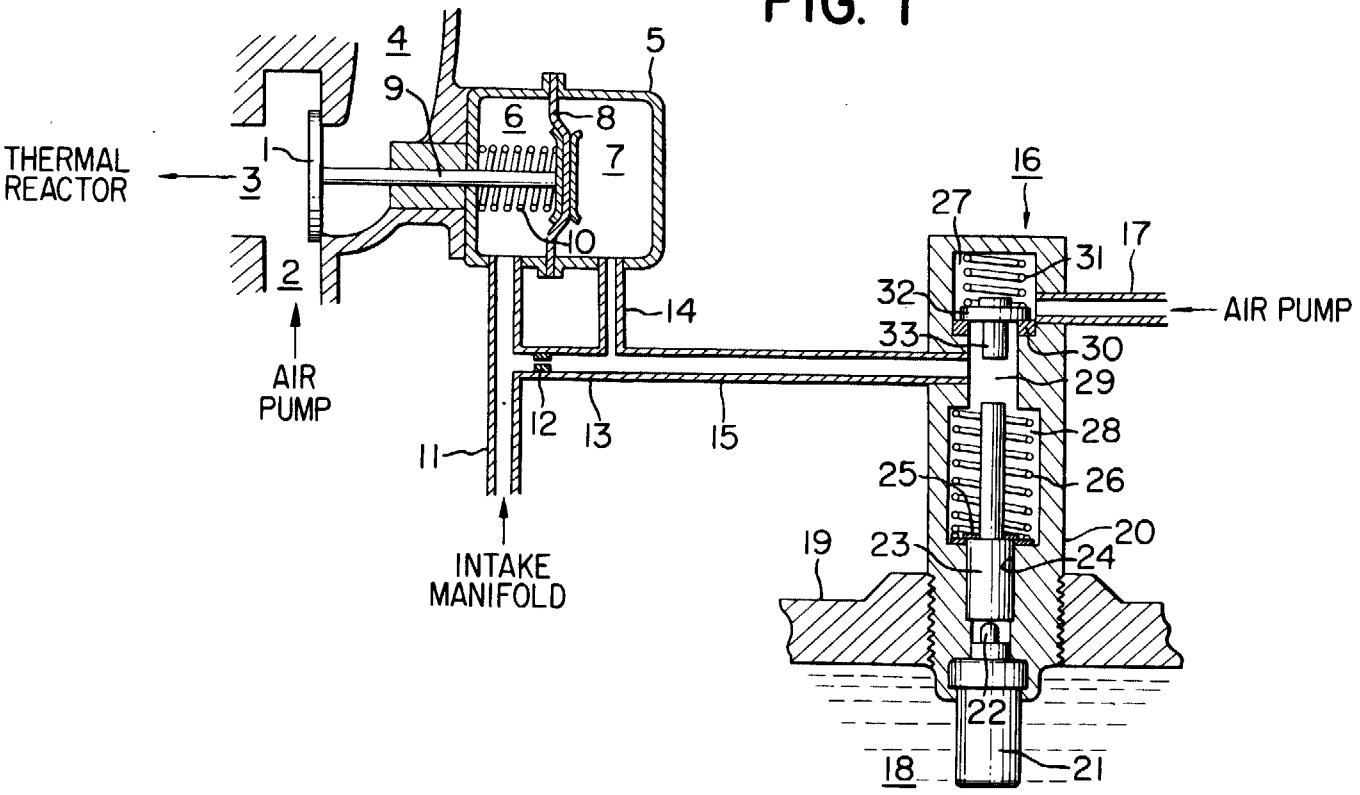
FIG. 1 is a cross-sectional view of a first embodiment of an anti-afterburn system according to the invention.

Referring to FIG. 1, there is shown a first embodiment of the anti-afterburn system.

The anti-afterburn system includes a control valve 1 which operates to change over secondary air introduced into a secondary air passage 2 from an air pump (not shown) to a passage 3 communicating with a thermal reactor (not shown) provided in an exhaust system for purifying the exhaust gas or to a relief port 4. This valve 1 is connected through a rod 9 to a central portion of a diaphragm 8 which divides a housing 5 into two chambers 6 and 7. A spring 10 is interposed between a housing wall surface of the chamber 6 and the diaphragm 8 and urges the control valve 1 to the right in FIG. 1 whenever the pressures in the chambers 6 and 7 are equal.

The chamber 6 is directly connected to an intake manifold (not shown) of the engine through a conduit 11. A branch conduit 13 having an orifice 12 therein is connected to the conduit 11 at the intermediate portion thereof and branched to two conduits 14 and 15. The conduit 14 is connected to the chamber 7 and the conduit 15 is connected to an outlet pipe 17 of the air pump through a thermo valve 16.

The thermo valve 16 includes a valve casing 20, a bottom of which is threadedly inserted into a portion of a passage 19 for engine cooling water 18. A wax element 21 is fitted on the bottom of the casing 20 and projects into the cooling water 18. The wax element 21 has a slidable rod 22 which slides up and down due to expansion or contraction of the element. An extremity of the slidable rod 22 abuts against a lower end of a valve stem 23 which is slidable along an inner circumferential sliding surface 24 of the casing 20. A retainer 25 for a spring is fixed to a stepped portion of the stem 23 and urged downwardly by a coil spring 26 embracing the stem. The valve casing 20 is formed with upper and lower chambers 27 and 28 of a relatively larger diameter and an intermediate chamber 29 of a smaller diameter. The upper chamber 27 is connected to one end of the outlet pipe 17. The intermediate chamber 29 is connected to one end of the conduit 15. A valve seat 30 is provided at a stepped portion between the chambers 27 and 29 and abuts against a valve member 32 urged downwardly by a spring 31 to separate between the chambers 27 and 29. The valve member 32 is provided with a downwardly extending projection 33, a lower end surface of which is adapted to engage with an upper end surface of the valve stem 23 when the latter moves upwardly.

The thermo valve 16 constructed as described above is so arranged that the valve stem 23 is positioned downwardly by a biasing force of the spring 26 as shown in FIG. 1 when a temperature of the cooling water 8 is low, thereby separating between the upper and intermediate chambers 27 and 29 by the valve member 32.

When the temperature of the cooling water 18 rises above a temperature at which the wax element 21 expands abruptly, the slidable rod 22 is extruded by expansion of the element 21 to move the valve stem 23 upwardly against the biasing force of spring 26. Thereafter, the stem 23 urges the projection 33 of the valve member 32 to force the member upwardly in opposition to the biasing force of spring 31. Therefore, the upper and intermediate chambers 27 and 29 are communicated to each other.

In this embodiment, the wax element 21 has an expanding characteristics that it expands abruptly when the temperature of the cooling water 18 reaches to approximately 95° C.

In operation of the above described embodiment, when the negative pressure in the intake manifold changes abruptly upon rapid deceleration of the vehicle, the chamber 6 is affected directly with this pressure change so that the pressure in the chamber 6 drops. The chamber 7 receives the relieved pressure change since this pressure change is transmitted to the chamber 7 through the orifice 12. Therefore, a pressure difference is produced between the chambers 6 and 7 upon initiation of the rapid deceleration, thereby moving the diaphragm 8 and the control valve 1 connected thereto towards the left in FIG. 1. By the movement of the valve 1, the passages 2 and 3 are disconnected to interrupt the secondary air supply from the air pump to the thermal reactor, thereby preventing the generation of the afterburn. When the pressures in the chambers 6 and 7 become same after a period of time, the diaphragm 8 and the control valve 1 return to their original positions shown in FIG. 1 to close the relief port 4.

Also, when the temperature of cooling water is increased above 95° C due to overheating of the engine, the thermo valve 16 is operated to communicate the outlet pipe 17 with the conduit 15, so that the outlet pressure of secondary air from the air pump is introduced into the chamber 7 through the outlet pipe 17, upper and intermediate chambers 27 and 29 and conduit 15. The diaphragm 8 is moved to the left in FIG. 1 by an urging force due to this secondary air outlet pressure and a suction force derived from the negative pressure in the intake manifold. The control valve 1 also moves to the left to disconnect between the passages 2 and 3. At this time, although the secondary air is also supplied to the conduit 11 through the orifice 12, the negative pressure prevailing in the conduit 11 will not be practically increased since only a slight amount of the secondary air is supplied thereto.

Thus, if the temperature of cooling water reaches above 95° C in the overheating condition of the engine, the supply of the secondary air to the thermal reactor is interrupted, thereby preventing the damages of the thermal reactor and generation of fire resulting from overheating of the reactor.

In the above described embodiment, the control valve 1 is operated by the diaphragm 8 located in the housing 5. Instead of this diaphragm, a pressure differential responsive member such as a piston may be mounted in the housing 5 to operate the control valve 1 in response to the pressures in two chambers defined by the member, so that the same operational effect is obtained.

Also, the outlet pipe 17 is supplied with the outlet pressure of the secondary air from the air pump, but this pipe may be opened to the atmosphere or communicated to an exhaust pipe to be supplied with an exhaust pressure.

Figure 2:
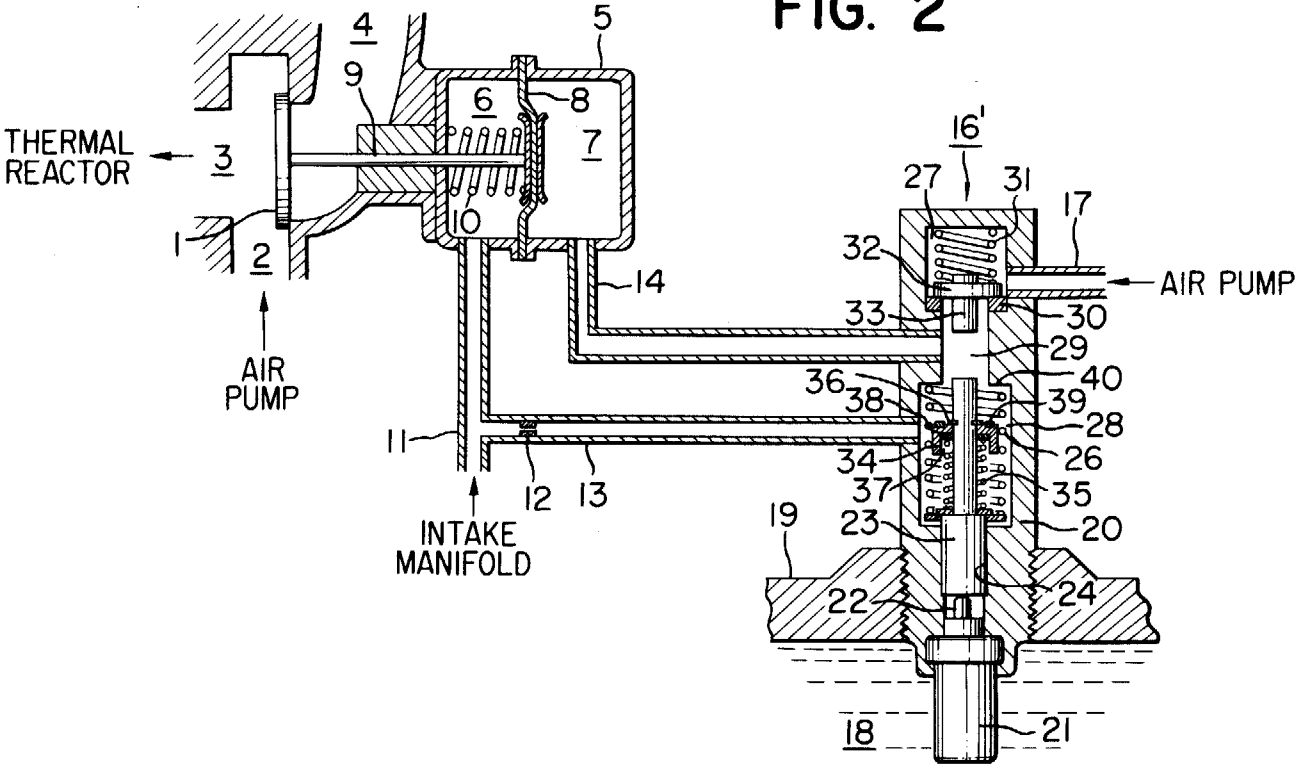
FIG. 2 is a cross-sectional view of a second embodiment of the anti-afterburn system according to the invention.

In a second embodiment of the invention shown in FIG. 2, a thermo valve 16' is slightly modified from the valve 16 of the first embodiment.

The thermo valve 16' is connected to one end of the conduit 13 branched from the conduit 11 and to one end of the conduit 14, the other end of which is connected to the chamber 7. The valve 16' is constructed by adding the following members to the thermo valve 16. That is, an annular valve member 34 is slidably mounted on the upper portion of the valve stem 23 and urged upwardly by a coil spring 35 encircling the stem 23. The valve member 34 is retained in a given position on the stem 23 by a retaining ring 36 fixed thereto.

The lower end of the spring 35 is carried by the retainer 25. A seal ring 38 is fitted in a groove 37 provided on a lower surface of the valve member 34 to seal a sliding portion between the valve stem 23 and the valve member 34. An upper surface of the valve member 34 is provided with an annular groove into which an annular resilient member 39 such as a rubber seat is fitted. A valve seat 40 formed at the stepped portion between the intermediate chamber 29 and the lower chamber 28 engages with the resilient member 39 to disconnect therebetween when the valve member 34 is moved upwardly. The end of the branch conduit 13 is connected to the lower chamber 28.

In this embodiment, the negative pressure in the intake manifold communicates to the chamber 6 directly throught the conduit 11 and to the chamber 7 through the orifice 12, branch conduit 13, chambers 28 and 29 and conduit 14 under a condition that the temperature of the cooling water 18 is less than 95° C. When said temperature reaches above 95° C, the valve stem 23 is moved upwardly by the expansion of the wax element 21, so that the resilient member 39 on the valve member 34 abuts against the valve seat 40. The valve stem 23 moves further upwardly to slide relative to the valve member 34 and urges the projection 33 to open the valve member 32. Therefore, the branch conduit 13 is closed and the conduit 14 communicates to the outlet pipe 17.

In this embodiment, the secondary air never flows from the branch conduit 13 to the conduit 11 through the orifice 12, so that operation of the control valve 1 is more reliable than that in the first embodiment.

Figure 3:
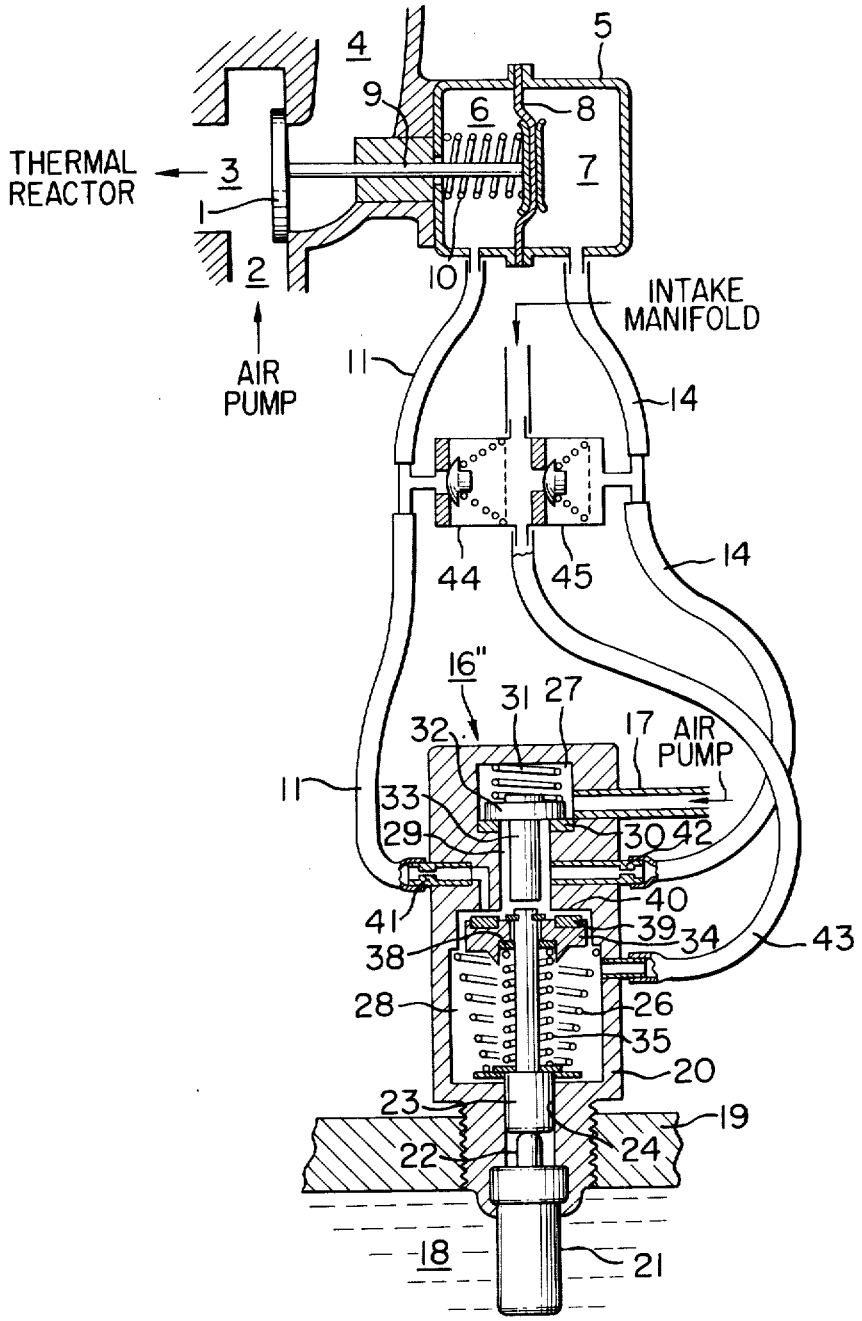
FIG. 3 is a cross-sectional view of a third embodiment of the anti-afterburn system according to the invention.

FIG. 3 shows a third embodiment of the anti-afterburn system according to the invention. A thermo valve 16" used in this embodiment is very similar to the thermo valve 16' in the second embodiment. A difference therebetween is that one open end of the conduit 11 is connected to a drilled passage provided in the valve seat 40. The other end of the conduit 11 is connected to the chamber 6. The conduit 14 is connected to the chamber 7 at its one end and to the intermediate chamber 29 at its other end. The connected portions between the thermo valve 16" and the conduits 11 and 14 are provided with orifices 41 and 42 respectively.

A conduit 43 is connected at one end to the lower chamber 28 and at the other end to the intake manifold. The conduits 11 and 14 are connected to the conduit 43 through check valves 44 and 45, respectively, to bypass the thermo valve 16". The check valve 44 permits a flow only in the direction from the conduit 11 to the conduit 43, while the check valve 45 permits a flow only in the direction from the conduit 43 to the conduit 14.

When the temperature of cooling water 18 is below 95° C, the thermo valve 16" communicates the conduit 43 with the conduits 11 and 14, and closes the outlet pipe 17. When said temperature is above 95° C, the valve stem 23 moves upwardly to cause the valve member 34 to close the conduit 11, thereby separating the intermediate chamber 29 from the lower chamber 28. Also, the valve member 32 is opened to permit a communication between the chambers 27 and 29, thereby connecting the outlet pipe 17 with the conduit 14.

In operation of the above described embodiment, when the negative pressure in the intake manifold is further reduced rapidly upon rapid deceleration, the pressure in the chamber 6 is also reduced through the conduit 43, check valve 44 and conduit 11. On the other hand, the chamber 7 communicates with this negative pressue through the conduit 43, lower and intermediate chambers 28 and 29 and conduit 14, since the check valve 45 prevents the flow of pressure therethrough. Therefore, the pressure in the chamber 7 is reduced gradually by means of the orifice 42. Thus, at initial stage of the deceleration, the diaphragm 8 and the control valve 1 move to the left in FIG. 3 to interrupt the secondary air supply to the thermal reactor, thereby preventing the afterburn.

When the negative pressure in the intake manifold is increased rapidly by abrupt acceleration, this increase of the pressure is transmitted to the chamber 7 through the conduit 43, check valve 45 and conduit 14. Also, the pressure increase is transmitted to the chamber 6 through the conduit 43, lower chamber 28, drilled passage and conduit 11, since the check valve 44 is closed by the pressure acting thereon. Therefore, the pressure in the chamber 6 is increased gradually so that diaphragm 8 and the control valve 1 are moved to the left in FIG. 3 for a few seconds upon initiation of the acceleration, thereby preventing the afterburn.

As described above, the intense afterburn which is especially generated upon rapid deceleration after the abrupt acceleration is effectively prevented.

When the temperature of the cooling water 18 rises above 95° C, the outlet pressure of the secondary air is transmitted to the chamber 7 through the outlet pipe 17, upper chamber 27, intermediate chamber 29 and conduit 14, while the negative pressure in the intake manifold communicates to the chamber 6 through the conduit 43, check valve 44 and conduit 11. Thus, in this case, the control valve 1 is also moved to the left in FIG. 3 to interrupt the secondary air supply to the thermal reactor, thereby preventing the overheating of the reactor and the generation of fire.

In the above respective embodiments, the thermo valve senses the temperature of cooling water 18 and is operated when the temperature reaches to approximately 95° C. However, operation of the thermo valve will not be limited to the above temperature, and the valve may be operated at any given temperature which causes overheating of the engine or the exhaust system.

Figure 4:
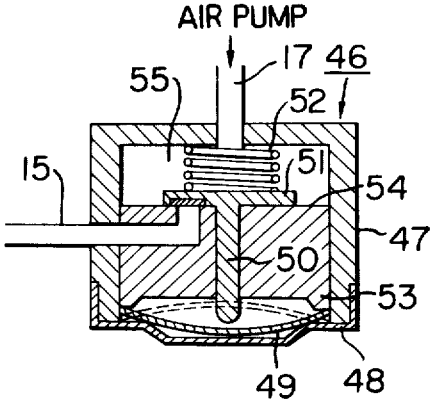
FIG. 4 is a cross-sectional view of a bimetal type thermo valve which can be used in the system shown in FIG. 1.
Figure 5:
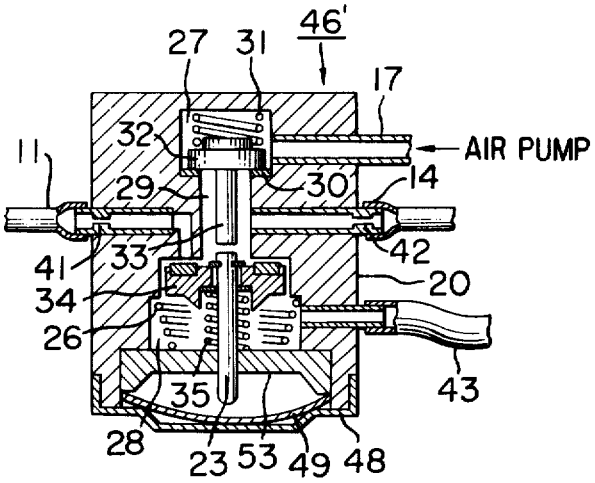
FIG. 5 is a cross-sectional view of a bimetal type thermo valve which can be used in the system shown in FIG. 3.

Also, the thermo valve shown in the above respective embodiments is of a wax element type, but it may be changed to a bimetal type as shown in FIG. 4 and 5. The thermo valve of this type detects the overheating of engine by sensing an environmental temperature in the engine room or around the thermal reactor.

In FIG. 4, the thermo valve 46 of the bimetal type is used as substitute for the thermo valve 16 in the first embodiment. The thermo valve 46 has a temperature sensing plate 48 connected to one end of a casing 47 and a bimetal 49 located adjacent to an inner surface of the plate 48. The bimetal 49 is deformable from one condition shown in a full line to the other condition shown in a broken line in FIG. 4 when it is heated, thereby moving upwardly a push pin 50 which forms the valve stem in the first embodiment. The pin 50 is attached at its upper end to a valve member 51 which is urged downwardly by a coil spring 52 to contact with an upper end surface 54 of a guiding member 53 for the pin 50. The surface 54 is provided with an opening connected to the conduit 15 in the first embodiment, and a chamber 55 defined between the casing 47 and the surface 54 is connected to the outlet pipe 17. Thus, when the temperature of bimetal 49 exceeds a setting value, the push pin 50 moves upwardly to communicate the conduit 15 with the outlet pipe 17.

The thermo valve 46' of bimetal type shown in FIG. 5 is used as substitute for the thermo valve 16" in the third embodiment and is identical thereto except that the temerature sensing plate 48 and bimetal 49 are provided instead of the wax element 21. This thermo valve 46' achieves the same operation as that in the third embodiment when the bimetal 49 is deformed and moves the valve stem 23 upwardly by increase of the environmental temperature.

What is claimed is:

1. An anti-afterburn system for an engine having an air pump, comprising a control valve for controlling secondary air supply from said pump to an exhaust system of the engine, a pressure differential responsive member dividing a housing into two chambers and being connected to said control valve, conduits connecting respectively said chambers with an intake manifold of the engine, a first orifice provided in one of said conduits so that said control valve is operated by abrupt variation of a pressure in said intake manifold to interrupt or reduce said secondary air supply, and a thermo valve means having a first chamber defined in a casing and supplied with an air pump pressure, a passage operatively connecting said first chamber with one of said two chambers, a first valve member opening and closing said passage, and a temperature sensing means responsive to a predetermined temperature to move said valve member so as to supply the air pump pressure to said one chamber, thereby operating said control valve to interrupt said secondary air supply, and said thermo valve means comprises a second chamber connected to said one chamber through said passage and to said first chamber which continuously communicates with the air pump pressure, said first valve member being located in said first chamber and normally closing the supply of said air pump pressure to said one chamber through said second chamber, a valve stem being slidably received in said casing adjacent to said sensing means, one end of said stem extending into said chamber and operatively connected to said first valve member to open the latter when the sensing means senses said predetermined temperature.

2. An anti-afterburn system according to claim 1, wherein said thermo valve means further comprises a third chamber continuously connected to said intake manifold through said one conduit, and a second valve member slidably mounted on said valve stem and normally opened to permit a communication between said second and third chambers so that said one chamber is connected to said manifold through said second and third chambers, said valve stem being movable from a first position in which said first valve member is closed and said second valve member is opened to a second position in which said second valve member is closed and said first valve member is opened when said sensing means senses said predetermined temperature, thereby permitting said pressure to communicate to said one chamber to operate said control valve.

3. An anti-afterburn system according to claim 2, wherein said temperature sensing means consists of a temperature sensing plate attached to one end of said casing and a bimetal being located adjacent to an inner surface of said plate and movable into a position in which the bimetal engages with said valve stem to move the latter into said second position when an environmental temperature in an engine room or around the exhaust system exceeds said predetermined temperature.

4. An anti-afterburn system according to claim 2, wherein said thermo valve means further comprises another passage being provided in a valve seat for said second valve member between said second and third chambers and connecting the other chamber of said housing with said third chamber, said another passage being opened and closed by said second valve member, and wherein a second orifice is provided in said another passage, check valves being provided in said conduits and bypassing said thermo valve means and said first and second orifices to directly connect said one and other chambers with said intake manifold, one of said check valves permitting flow of the pressure from the intake manifold to said one chamber while the other check valve permits the flow of the pressure from said other chamber to the manifold.

5. An anti-afterburn system for an engine having an air pump, comprising a control valve for controlling secondary air supply from said pump to an exhaust system of the engine, a pressure differential responsive member dividing a housing into two chambers and being connected to said control valve, conduits connecting respectively said chambers with an intake manifold of the engine, a first orifice provided in one of said conduits so that said control valve is operated by abrupt variation of a pressure in said intake manifold to interrupt or reduce said secondary air supply, and a thermo valve means having a first chamber defined in a casing and supplied with an air pump pressure, a passage operatively connecting said first chamber with one of said two chambers, a first valve member opening and closing said passage, and a temperature sensing means responsive to a predetermined temperature to move said valve member so as to supply the air pump pressure to said one chamber, thereby operating said control valve to interrupt said secondary air supply, said first valve member being located in said first chamber and normally closing the supply of said air pump pressure to said one chamber, a valve stem being slidably received in said casing adjacent to said sensing means, one end of said stem operatively connected to said first valve member to open the latter when the sensing means senses said predetermined temperature, wherein a temperature sensing plate is attached to one end of said casing, and a bimetal being located adjacent to an inner surface of said plate and movable into a position in which the bimetal engages with a pin on said stem of said first valve member to open said first valve member when an environmental temperature in an engine room or around the exhaust system exceeds a predetermined temperature.

* * * * *